US005526738A

United States Patent [19]

Logan

[11] Patent Number: 5,526,738

[45] Date of Patent: Jun. 18, 1996

[54] HYDRAULIC PRESS WITH FLYWHEEL

[76] Inventor: Eugene T. Logan, 449 Queens Rd., Salina, Kans. 67401

[21] Appl. No.: 200,072

[22] Filed: Feb. 22, 1994

[51] Int. Cl.[6] ..... B30B 1/32

[52] U.S. Cl. ..... 100/35; 60/371; 72/453.11; 100/48; 100/269.14; 100/270

[58] Field of Search ..... 100/35, 48, 269 R, 100/270; 60/371; 72/453.1, 453.11

[56] References Cited

U.S. PATENT DOCUMENTS

| | | | |
|---|---|---|---|
| 2,188,956 | 2/1940 | Norin et al. | 60/371 |
| 2,405,537 | 8/1946 | Werner et al. | 100/269 R |
| 2,614,539 | 10/1952 | Ernst | 100/269 R |
| 3,805,638 | 4/1974 | Herdzina | 74/572 |
| 3,983,738 | 10/1976 | Vlasov et al. | 72/429 |
| 4,084,924 | 4/1978 | Ivanoff et al. | 417/424 |
| 4,712,439 | 12/1987 | North | 74/84 |
| 4,765,198 | 8/1988 | Stravrinidis | 74/572 |
| 4,788,882 | 12/1988 | Fulop | 74/572 |
| 4,860,611 | 8/1989 | Flanagan et al. | 74/574 |
| 4,888,949 | 12/1989 | Rogers | 60/434 |
| 4,928,553 | 5/1990 | Wagner | 475/268 |
| 5,081,884 | 1/1992 | Cheng et al. | 74/595 |
| 5,158,723 | 10/1992 | Walchhutter et al. | 100/269 R |
| 5,203,227 | 4/1993 | Li | 74/572 |

FOREIGN PATENT DOCUMENTS

| | | | |
|---|---|---|---|
| 0116024 | 8/1984 | European Pat. Off. | 100/269 R |
| 3017406 | 11/1981 | Germany | 100/48 |
| 56-111594 | 9/1981 | Japan | 100/269 R |

OTHER PUBLICATIONS

Maleev, V. L., *Machine Design*, Great Britain: International Textbook Company, 1946.

"Dake Hydraulic Presses", Catalog 415B, Dake Corporation, Grand Haven, Michigan, 1978.

"Rockford Hydraulic Power Presses", Catalog Hyp, Rockford Systems, Inc., Rockford, Illinois, 1984.

"Understanding Presses and Press Operations", Society of Manufacturing Engineers, Dearborn, Michigan, 1981.

*Primary Examiner*—Stephen F. Gerrity

*Attorney, Agent, or Firm*—Head & Johnson

[57] ABSTRACT

A hydraulic press of the type having at least one hydraulic pump driven by a rotary shaft and a hydraulically operable ram is provided with an improvement comprising a flywheel connected to the pump shaft. According to another aspect, the ram is reciprocated between retracted and extended positions by rotating the pump shaft and the flywheel at a predetermined rotational speed so as to operate the pump(s) and deliver fluid to the hydraulically operable ram.

11 Claims, 2 Drawing Sheets

HYDRAULIC PRESS WITH FLYWHEEL

BACKGROUND OF THE INVENTION

This invention relates to the field of hydraulic presses and improvements relating thereto.

The hydraulic press has long been a useful tool in industry for performing various pressing operations such as blanking, stamping, and drawing. The basic design of the typical hydraulic press comprises a motor for driving a hydraulic pump so that such pump delivers a suitable hydraulic fluid, such as oil, to alternate sides of a piston at corresponding downstroke and upstroke positions of a reciprocation cycle (hereafter sometimes denoted as simply a "stroke"). The piston, as slidably received in a cylinder, is connected to a ram member (such as simply a plate, or a suitably shaped die for stamping or blanking) which contacts a workpiece upon the downstroke of the ram member.

Although prior art hydraulic presses have long been successfully used in industry, it would be desirable to provide improvement(s) which would decrease the horsepower requirements of the motor to achieve a desired force upon the workpiece (hereafter referred to as "tonnage", or the number of tons exerted upon the workpiece by the ram member), while at the same time permitting operation of the press at different reciprocation speeds(i.e. in strokes per minute or s.p.m.) at a constant desired tonnage.

SUMMARY OF THE INVENTION

It is, therefore, an object of the invention to provide an apparatus and method for performing hydraulic pressing operations at uniform stroke velocity which can employ a motor of a lower horsepower rating than that required in prior art hydraulic presses to achieve a desired tonnage.

It is also an object of the invention to accomplish the above-mentioned object while at the same time permitting multi-speed operation of the press at a constant desired tonnage.

The above objects are realized by a hydraulic press of the type comprising at least one hydraulic pump having a rotary shaft extending therefrom which is hereafter denoted as the pump shaft, a means for rotating the pump shaft (i.e. a motor) so as to operate the hydraulic pump(s) and pump a hydraulic fluid therefrom and a ram means hydraulically operable by means of hydraulic fluid received from the hydraulic pump(s) so as to reciprocate between a retracted position, out of contact with a workpiece as positioned on a bed, and an extended position in contact with the workpiece, the improvement comprising: a flywheel concentrically and fixedly connected to the pump shaft.

According to another aspect of the invention, there is provided a method of performing a hydraulic pressing operation of the type which comprises pumping a hydraulic fluid from at least one hydraulic pump to a ram means by rotating a rotary shaft (i.e. by a motor) extending from the pump, thereby causing the ram means to reciprocate between a retracted position, out of contact with a workpiece as positioned on a bed, and an extended position in contact with the workpiece, the improvement comprising: rotating a flywheel at a predetermined rotational speed with the pump shaft, the flywheel being concentrically and fixedly connected to the pump shaft.

The flywheel as connected to the pump shaft in accordance with the invention serves to decrease the horsepower requirements (i.e. of a motor) necessary to drive the hydraulic pump(s) and achieve a given tonnage of force as applied to the workpiece by the ram member in its extended position. Furthermore, employing the flywheel connected to the pump shaft in accordance with the invention, in conjunction with a hydraulic adjustment means for adjusting the flow of hydraulic fluid from the hydraulic pump(s) to the ram means, enables variance of the speed of reciprocation of the ram means without changing the flywheel rotational speed. One example of hydraulic adjustment means includes the use of selective dumping of fixed volume pumps to achieve differing flow rates. Another example of hydraulic adjustment means includes the use of a variable volume pump. Therefore, the energy stored by the flywheel in the portion of the reciprocation cycle prior to contact with the workpiece remains constant for different reciprocation speeds, consequently enabling a constant tonnage upon a particular workpiece for the different reciprocation speeds. This further permits performance of different hydraulic pressing operations, such as blanking at a typically high speed and drawing a typically low speed, without any sacrifice of tonnage capacity due to a change in the reciprocation speed.

Another aspect of the invention is the use of a single hydraulic pump, with a shaft and flywheel, that can be adjusted mechanically or pneumatically to a variety of strokes per minute (s.p.m.) as needed for a particular job. In some instances, a single stroke speed is all that is necessary to accomplish the work without downshifting from low to high volumes.

DETAILED DESCRIPTION OF THE PREFERRED EMBODIMENT

A preferred embodiment of the invention will now be described with reference to the FIGURES.

Figure 1:
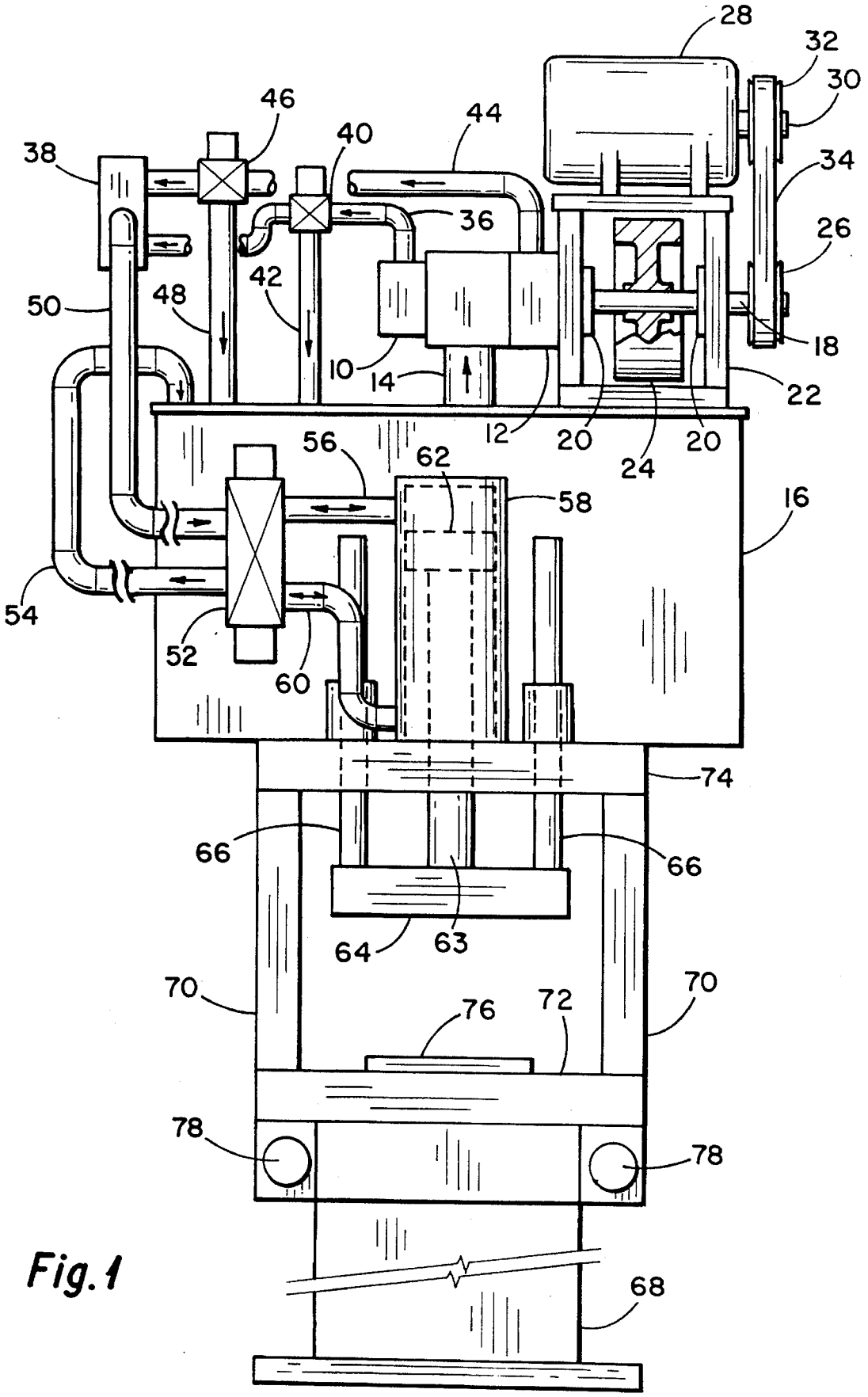
FIG. 1 is a frontal view of a hydraulic press in accordance with a preferred embodiment of the invention, wherein the ram member of the press is shown in its retracted position.

Referring to FIG. 1, the illustrated hydraulic press includes a small fixed volume hydraulic pump 10 and a large fixed volume hydraulic pump 12. A pump inlet line 14 extends between the pumps and a hydraulic fluid reservoir 16, and a rotary shaft (hereafter denoted as the pump shaft) extends from the pumps so as to be received through sleeves 20 as mounted in a suitable support bracket 22. Both of the small and high volume pumps 10 and 12 are driven by pump shaft 18.

At any particular rotational speed of pump shaft 18, small volume pump 10 will pump hydraulic fluid at a first flow rate and the large volume pump 12 will pump hydraulic fluid at a second flow rate greater than the first flow rate. Typical flow rate pumping capabilities for the two pumps, for most applications as expressed volumetrically, are within the range of about 4 GPM–45 GPM for the small volume pump 10 and about 8 GPM–85 GPM for the large volume pump 12, assuming typical rotational speeds of pump shaft 18 as later discussed.

Concentrically and fixedly connected to pump shaft 18 is a flywheel 24, of preferably metallic construction such as cast iron, cast steel or steel. Flywheel 24 is shown in partial cross section to reveal a structure which has a maximum thickness at the rim of such flywheel in order to optimize its energy storage capabilities. A typical weight for flywheel 24 that is suitable for most applications ranges between about 25 to 175 pounds. Also, concentrically and fixedly connected to pump shaft 18 is a sheave 26 near the outer end of pump shaft 18.

Motor 28, of an electric or any other suitable type, is shown in the illustrated embodiment as being mounted on top of support bracket 22, and is further shown as having extending therefrom a rotary shaft 30, hereafter referred to as the motor shaft. Sheave 32 is concentrically and fixedly connected to motor shaft 30. Drive belt 34 extends from sheave 32 to sheave 26 so as to indirectly but operably connect motor shaft 30 to pump shaft 18. A typical horsepower rating for motor 28 that is suitable for most applications ranges between about 2–30 horsepower.

Pump outlet line 36 extends from small volume pump 10 to manifold 38. Directional valve 40 is positioned along line 36 and is operable to direct flow of hydraulic fluid either to manifold 38 or to reservoir 16 via line 42. Similarly, pump outlet line 44 extends from large volume pump 12 to manifold 38, and directional valve 46 as positioned along line line 44 is operable to direct flow of hydraulic fluid either to manifold 38 or to reservoir 16 via line 48.

As shown, line 50 extends from manifold 38 to a directional valve 52, and line 54 extends from reservoir 16 to directional valve 52. Line 56 extends from directional valve 52 to the upper end of a cylinder 58 (the inner wall of which is shown in dashed lines), and line 60 extends from directional valve 52 to the lower end of cylinder 58. Directional valve 52 is adapted to receive incoming hydraulic fluid via line 50 and to return exiting fluids to reservoir 16 via line 54. Directional valve is selectively operable to either (i) receive fluid via line 56 from the upper end of cylinder 58 and press exiting fluid to the lower end of cylinder 58 via line 60, or (ii) receive fluid via line 60 from the lower end of cylinder 58 and pass exiting fluid to the upper end of cylinder 58 via line line 56.

Figure 2:
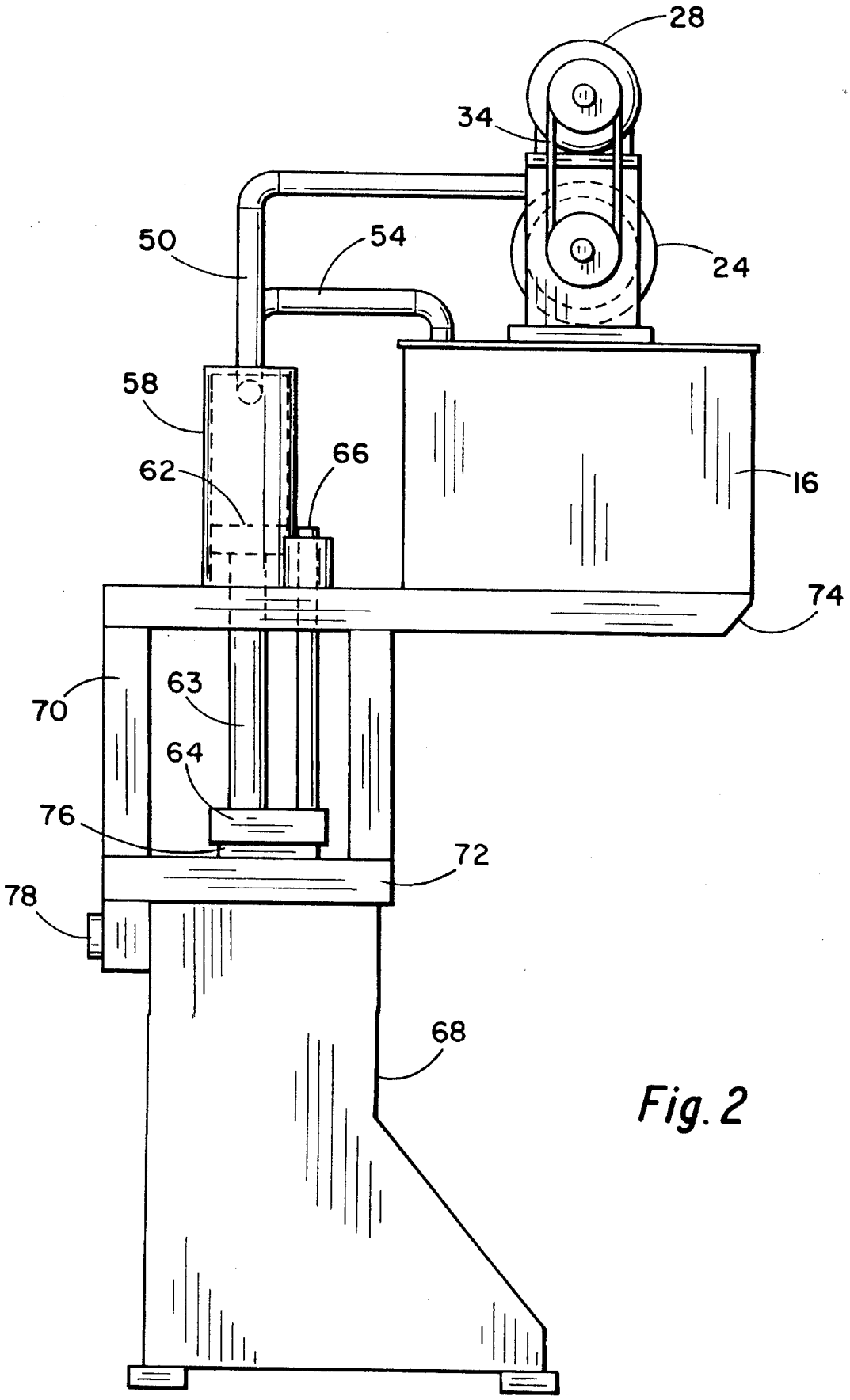
FIG. 2 is a side view of the hydraulic press of FIG. 2, wherein the ram member is shown in its extended position in contact with a workpiece.

Piston 62 is slidably received within cylinder 58 and is connected through piston rod 63 to the upper face of a ram member 64. Therefore, ram member 64 is reciprocable, by means of the upward or downward motion of piston 62, between a retracted position shown in FIG. 1 and an extended position which is shown in FIG. 2. Ram member 64, which may take various forms such as simply a plate, or a shaped die for blanking or stamping, is stabilized by guides 66.

Supporting the various components of the press as are described above is a base 68, spacer supports 70, a bed 72 positioned between base 68 and spacer supports 70, and a support plate 74 mounted upon the upper ends of spacer supports 70. As shown, bed 72 is adapted to receive a workpiece 76. Also shown in FIG. 1 are two hand control switches 78 positioned adjacent to base 68 and which must both be depressed simultaneously to place the hydraulic press into operation. Since an operator must use each hand to manipulate the switches in this manner, this arrangement serves as a safety precaution for the operator.

Referring to FIG. 2, there is shown a side view of the hydraulic press of FIG. 1. FIG. 2 shows by means of dashed lines the outer rim of flywheel 24. FIG. 2 also shows ram member 64 in its extended position in contact with workpiece 76.

Operation of the hydraulic press of the invention will now be described. Flow directions are indicated by arrows.

Referring again to FIG. 1, a motor start switch (not shown) is depressed by an operator to start operation of motor 28, thus causing rotation of motor shaft 30 and also pump shaft 18 via drive belt 34. The flywheel 24, as concentrically and fixedly connected to the pump shaft 18, rotates with pump shaft 18 at a predetermined (as determined by the r.p.m. rating of the motor and diameter difference of sheave 26 and 32) and desired rotational speed, typically about 1000–3000 r.p.m. (revolutions per minute) for most applications. Rotation of pump shaft 18 operates small volume pump 10 and large volume pump 12, which thereby pump hydraulic fluid therefrom through respective lines 36 and 44.

A high speed (reciprocation speed in, for example, strokes per minute or s.p.m.) mode of operation is shown in FIG. 1, where directional valves 40 and 46 are set to direct flow of hydraulic fluid from each of small and high volume pumps 10 and 12 to manifold 38. This mode of operation maximizes the flow rate of fluid delivered to and through manifold 38 (and ultimately to cylinder 58 as discussed further below). Adjustment to an intermediate reciprocation speed can be accomplished by setting directional valve 40 to direct flow of fluid from small volume pump 10 to reservoir 16 via line 42, as indicated by the dashed arrow in line 42, thereby adjusting the flow rate of fluid to manifold 38 to an intermediate level. Similarly, adjustment to a low reciprocation speed can be accomplished by setting directional valve 46 to direct flow of fluid from large volume pump 12 to reservoir 16 via line 48, as indicated by the dashed arrow in line 48, thereby adjusting the flow rate of fluid to manifold 38 to a low level.

An alternate means to obtain a high speed to low speed (reciprocation speed in strokes per minute s.p.m.) mode of operation is by the use of at least one variable volume pump. A variable volume vane type pump is typical. Volume adjustment occurs by varying the position of the cam ring relative to the rotor. Referring to FIG. 1, pump 10 would become the variable volume pump. As such, directional valve 40, conduits 42, 44, and 48, manifold 38 and directional valve 46 would not be necessary. Line 36 would then be connected to line 50.

Adjustment to higher or lower reciprocation speed is made by an accessible knob means attached to pump 10 adjustment mechanism (not shown). Rotation of the knob means would thereby adjust the displacement of pump 10 and in turn change the fluid flow rate to directional valve 52.

Other forms of variable volume pumps include gear pumps (by varying the r.p.m.) and variable volume axial piston pumps (by changing the angle of the swash plate).

Regardless of what reciprocation speed is selected, typically in the range of about 20–100 s.p.m.) the predetermined rotational speed of flywheel 24 remains the same. Therefore, energy storage by flywheel 24 remains constant for any selected reciprocation speed, and, as will be more apparent from the discussion below, the resulting tonnage upon a particular workpiece also remains constant. This further means that one can easily change from a pressing operation typically carried out at a high reciprocation speed, such as blanking, to a pressing operation typically carried out at a lower reciprocation speed, such as drawing, without any sacrifice of tonnage capacity due to the decrease in reciprocation speed. The hydraulic press according to the invention is therefore easily and effectively adaptable to different pressing applications. In this regard, ram member 64 preferably has removable tooling attached to the working face tooling types and shapes for different applications.

As shown in FIG. 1, hydraulic fluid is passed from manifold 38 to directional valve 52 via line 50. In the retracted position of ram member 64 and piston 62 as shown in FIG. 1, directional valve 52 is set to direct flow of fluid, as it passes into directional valve 52 from line 50, through line 56 to the upper end of cylinder 58 above piston 62, as indicated by the arrow pointing to the right. Piston 62 is forced downward as soon as the fluid pressure (i.e. normally less than 100 p.s.i.) becomes sufficient to overcome friction and accelerate the combined masses of piston 62, piston rod 63, and ram member 64. Gravity has only a minor effect. Movement of piston 62 in a downward direction causes any fluid below piston 62 to flow through line 60 to directional valve 52 in the direction of the arrow pointing to the left. This fluid as received by directional valve 52 is then directed by such directional valve through line 54 and back to reservoir 16.

As soon as the ram member 64 contacts workpiece 76, a rapid increase in fluid pressure occurs above piston 62. The hydraulic press will typically be equipped with means (not shown, and commonly known as "overload protection") for preventing the fluid pressure from exceeding some predetermined maximum valve. The rapid increase in fluid pressure resulting from contact with workpiece 76 creates a momentary high energy demand exceeding the energy available from motor 28 alone, in view of the fact that the horsepower selected for motor 28 will intentionally have this major deficiency in order to minimize the horsepower requirement of motor. Since flywheel 24 is fixedly connected to pump shaft 18 and has stored energy while rotating during the downstroke of ram member 64, there is an instantaneous transfer of flywheel energy to the hydraulic pump(s) which maintains the fluid flow and pressure necessary for completion of the downstroke after contact with workpiece 76, thus completing the desired work (i.e. blanking or drawing) upon workpiece 76. The ram member 64 thereby assumes its extended position shown in FIG. 2. Fluid pressure above piston 62 during the "work phase", or that phase of the reciprocation cycle between the moment of contact with the workpiece and completion of the downstroke, is typically in the range of about 1000–3000 p.s.i., such pressure depending in part on the workpiece and particular pressing operation employed.

The rotational speed of flywheel 24 and pump shaft 18 will typically be reduced somewhat at this point of the reciprocation cycle, but will be quickly restored to the desired and predetermined rotational speed during the upstroke and beginning downstroke portion of the reciprocation cycle. This upstroke of ram member 64 begins in response to actuation of a suitable limit switch (not shown) at the extended position of ram member 64, automatically actuating directional valve 52 to a setting in which hydraulic fluid is passed from directional valve 52 through line 60 and to the lower end of cylinder 58 below piston 62, as indicated by the arrow in line 60 pointing to the right. Fluid passes from the upper end of cylinder 58 through line 56 and to directional valve 52, as is indicated by the arrow in line 56 pointing to the left. At the completion of the upstroke at the retracted position of ram member 64 and piston 62, thereby completing a full reciprocation cycle, a second limit switch (not shown) is actuated to reset directional valve 52 for another downstroke.

If at any point in a reciprocation cycle the operator removes one or both hands from switches 78, the hydraulic press is preferably designed to automatically actuate the directional valve 52 to return ram member 64 and piston 62 to the retracted position (if not already in that position), at which point fluid flow to and from lines 56 and 60 is closed off by directional valve 52, trapping fluid on each side of piston 62 and maintaining ram member 64 and piston 62 in the retracted position. As long as motor 28 is allowed to operate, directional valve 52 directs all incoming fluid from line 50 back to reservoir 16 via line 54.

Obviously many modifications and variations of the present invention are possible in light of the above teachings, and it is understood that within the scope of the appended claims the invention may be practical otherwise than is specifically described.

EXAMPLE

This calculated example is provided to further illustrate the invention and its advantages, and should not be construed to limit the invention in any manner.

Set forth below in Table 1 is a typical set of specifications for a hydraulic press in accordance with he invention and as illustrated in the FIGURES.

TABLE 1

| ITEM | DIMENSION/VALUE |
|---|---|
| Motor 28 horsepower rating | 7.5 H.P. |
| Flywheel 24 diameter | 11 inches |
| Flywheel 24 weight | 60 pounds |
| Nominal rotational speed of pump shaft 18/flywheel 24 | 1800 r.p.m. |
| Flow rate from small volume pump 10 | 19 G.P.M. |
| Flow rate from large volume pump 12 | 40 G.P.M. |
| Diameter of piston 62 | 6 inches |
| Combined weight of piston 62, piston rod 63 and ram member 64 | 300 pounds |
| Distance of downstroke/upstroke | 2.5 inches |
| Low reciprocation speed | 30 s.p.m. |
| Intermediate reciprocation speed | 60 s.p.m. |
| High reciprocation speed | 90 s.p.m. |
| Tonnage capacity (maximum available tonnage for all reciprocation speeds) | 30 tons |

Firstly, Table 1 indicates a relatively low horsepower (7.5) motor capable in conjunction with flywheel connected to the pump shaft of achieving a tonnage of 30 tons. Compare this to 80 horsepower which would be required by a motor in a hydraulic press having uniform stroke velocity and the same specifications as in Table 1, but without the flywheel connected to the pump shaft. More than ten times the horsepower is required than in the press of the invention, meaning a substantially higher cost in equipment and energy.

Secondly, Table 1 indicates the same tonnage capacity (30 tons) for each of the three reciprocation speeds employing a flywheel having a relatively high rotational speed (1800 r.p.m.) and a relatively low weight (60 lbs.). In Table 2, these specifications (under "Inv." for Inventions) are compared to those for a comparative press which is a geared, flywheel drive mechanical press (under "Comp." for Comparative press) having a flywheel indirectly connected to the crankshaft by means of a 10:1 geared drive and having the same upstroke/downstroke distance.

TABLE 2

| Recip. Speed | Flywheel Speed (r.p.m.) | | Flywheel Wt. (lbs.) | | Tonnage Cap. (Tons) | |
|---|---|---|---|---|---|---|
| (s.p.m.) | Inv. | Comp | Inv. | Comp. | Inv. | Comp. |
| 30 | 1800 | 300 | 60 | 200 | 30 | 3.5 |
| 60 | 1800 | 600 | 60 | 200 | 30 | 13 |
| 90 | 1800 | 900 | 60 | 200 | 30 | 30 |

It can be seen from Table 2 that the comparative press employs a heavier flywheel (of the same diameter) at a lower rotational speed than the flywheel of the inventive press, since the flywheel rotational speed of the comparative press is ten times the reciprocation speed so as to require a heavier flywheel. More importantly, the flywheel rotational speed is different for each of the reciprocation speeds in the comparative press, thus also resulting in different tonnage capacities for the various reciprocation speeds. Note in particular the great sacrifice in tonnage capacity for the comparative press at the lower reciprocation speeds as compared to the constant and higher tonnage capacities for the inventive press.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A hydraulic press comprising at least one hydraulic pump having a rotary shaft extending therefrom, a means for rotating the rotary shaft so as to operate said at least one hydraulic pump and pump a hydraulic fluid therefrom and a ram means hydraulically operable by means of hydraulic fluid received from said at least one hydraulic pump so as to reciprocate between a retracted position, out of contact with a workpiece as positioned on a bed, and an extended position in contact with the workpiece;

a flywheel concentrically and fixedly connected to the means for rotating said rotary shaft; and wherein the at least one hydraulic pump comprises a first hydraulic pump and a second hydraulic pump which are both driven by the rotary shaft, and wherein for any particular rotational speed of the rotary shaft the first hydraulic pump will pump hydraulic fluid at a first flow rate and the second hydraulic pump will pump hydraulic fluid at a second flow rate different than the first flow rate; and a hydraulic adjustment means for adjusting the flow rate of the hydraulic fluid to the ram means and thus also the speed of reciprocation of the ram means, the hydraulic adjustment means comprising a valve means for selectively delivering hydraulic fluid from the first and second hydraulic pumps to the ram means.

2. A hydraulic press of claim 1 wherein at least one hydraulic pump is a variable volume pump.

3. A hydraulic press comprising:

said press having a hydraulically operated ram means;

a pump shaft and means including a flywheel to rotate the pump shaft;

a first hydraulic pump and a second hydraulic pump which are both driven by the pump shaft; and for any particular rotational speed of the pump shaft, the first hydraulic pump will pump hydraulic fluid to the ram means at a first flow rate, and the second hydraulic pump will pump hydraulic fluid to the ram means at a second flow rate different than the first flow rate.

4. A hydraulic press as recited in claim 3 wherein at least one of said first and second hydraulic pumps is a variable volume pump.

5. A hydraulic press as recited in claim 3, wherein the means for rotating the pump shaft comprises a motor having a motor shaft extending therefrom, and further comprising a connecting means for operably but indirectly connecting the motor shaft to the pump shaft.

6. A hydraulic press as recited in claim 5 wherein the connecting means comprises a drive belt.

7. A hydraulic press as recited in claim 5, wherein the motor has a horsepower of about 2–30, and the flywheel has a weight of about 25–175 pounds.

8. A method of performing a hydraulic pressing operation which comprises pumping a hydraulic fluid from a first hydraulic pump and a second hydraulic pump both driven by a pump shaft, thereby causing a ram means to reciprocate between a retracted position, out of contact with a workpiece as positioned on a bed, and an extended position in contact with the workpiece, the improvement comprising:

rotating a flywheel at a predetermined rotational speed with the pump shaft, the flywheel being concentrically and fixedly connected to the pump shaft, adjusting the flow rate of hydraulic fluid delivered to the ram means by the first hydraulic pump at a first flow rate and the second hydraulic pump will pump hydraulic fluid to the ram means at a second flow rate different than the first flow rate to thereby also adjust the speed of reciprocation of the ram means, the flow rate as delivered to the ram means being adjusted by selectively delivering hydraulic fluid from one or both of the first and second hydraulic pumps to the ram means, and wherein the predetermined rotational speed of the pump shaft and flywheel remains the same for the corresponding first and second flow rates.

9. The method of claim 8 wherein at least one of said first and second hydraulic pumps is a variable volume pump.

10. A method as recited in claim 8 wherein rotation of the pump shaft is by means of a motor having a rotary shaft extending therefrom, which is operably but indirectly connected to the pump shaft.

11. A method as recited in claim 10, wherein the rotary shaft is connected to the pump shaft by a drive belt which rotates the pump shaft in response to rotation of the motor shaft.

* * * * *